US009291974B2

(12) United States Patent
Sugiyama

(10) Patent No.: US 9,291,974 B2
(45) Date of Patent: Mar. 22, 2016

(54) IMAGE FORMING APPARATUS EXECUTING A PLURALITY OF TYPES OF MISREGISTRATION CORRECTION CONTROL

(71) Applicant: CANON KABUSHIKI KAISHA, Tokyo (JP)

(72) Inventor: Yuki Sugiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/287,520

(22) Filed: May 27, 2014

(65) Prior Publication Data

US 2014/0363211 A1 Dec. 11, 2014

(30) Foreign Application Priority Data

Jun. 6, 2013 (JP) ..... 2013-120107

(51) Int. Cl.
*G03G 15/20* (2006.01)
*G03G 15/00* (2006.01)

(52) U.S. Cl.
CPC .... *G03G 15/5058* (2013.01); *G03G 2215/0132* (2013.01); *G03G 2215/0161* (2013.01)

(58) Field of Classification Search
CPC ..... G03G 15/6573; G03G 21/00; G03G 2215/00421; G03G 15/6502; B41J 2/335
See application file for complete search history.

(56) References Cited

U.S. PATENT DOCUMENTS

| | | | | |
|---|---|---|---|---|
| 8,571,451 | B2 * | 10/2013 | Teshima et al. | 399/301 |
| 8,600,274 | B2 | 12/2013 | Uchiyama et al. | |
| 2006/0139433 | A1 * | 6/2006 | Yoshida | 347/116 |
| 2007/0122171 | A1 * | 5/2007 | Fujimori et al. | 399/38 |
| 2008/0279599 | A1 * | 11/2008 | Nagatsuka | 399/301 |
| 2012/0328310 | A1 * | 12/2012 | Ohashi | 399/39 |
| 2013/0100226 | A1 * | 4/2013 | Ninomiya | 347/224 |
| 2014/0016955 | A1 | 1/2014 | Uchiyama et al. | |

FOREIGN PATENT DOCUMENTS

| | | | |
|---|---|---|---|
| JP | 2003-207976 | A | 7/2003 |
| JP | 2008-033168 | A | 2/2008 |
| JP | 2010-091925 | A | 4/2010 |
| JP | 2012-032777 | A | 2/2012 |

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image forming apparatus includes: an image forming unit configured to form developer images of a plurality of colors on an image carrier; and a control unit configured to execute a first correction control and a second correction control that has a higher correction precision than the first correction control in order to correct misregistration between the developer images formed by the image forming unit. The control unit is further configured to execute the second correction control when a cumulative correction error, which is a cumulative value of correction error occurring when performing misregistration correction using the first correction control, exceeds a first threshold.

22 Claims, 12 Drawing Sheets

FIG. 8A

| | DURING PRINTING | NOT DURING PRINTING |
|---|---|---|
| Ct<100 | +4 | -1 |
| 100≤Ct<200 | +3 | -2 |
| 200≤Ct<300 | +2 | -3 |
| 300≤Ct | +1 | -4 |

FIG. 8B

| | ΔYM | ΔYC | ΔYBk |
|---|---|---|---|
| ΔCt<-400 | -1 | +2 | +2 |
| -400≤ΔCt<-200 | 0 | +1 | +1 |
| -200≤ΔCt≤300 | 0 | 0 | 0 |
| 300<ΔCt≤500 | 0 | -1 | -1 |
| 500<ΔCt | +1 | -2 | -2 |

FIG. 9A

| | MAGENTA | CYAN | BLACK |
|---|---|---|---|
| ΔCt<-400 | +3 | +6 | +6 |
| -400≤ΔCt<-200 | +1 | +3 | +3 |
| -200≤ΔCt≤300 | 0 | 0 | 0 |
| 300<ΔCt≤500 | +1 | +3 | +3 |
| 500<ΔCt | +3 | +6 | +6 |

FIG. 9B

| | YELLOW | MAGENTA | CYAN | BLACK |
|---|---|---|---|---|
| N≥102% | -3 | -2 | -1 | -1 |
| 102%>N≥101% | -2 | -1 | 0 | 0 |
| 101%>N≥99% | 0 | 0 | 0 | 0 |
| 99%>N≥98% | +1 | +2 | +3 | +3 |
| 98%>N | +2 | +2 | +3 | +3 |

IMAGE FORMING APPARATUS EXECUTING A PLURALITY OF TYPES OF MISREGISTRATION CORRECTION CONTROL

BACKGROUND OF THE INVENTION

1. Field of the Invention

The present invention relates to electrophotographic image forming apparatuses, and particularly relates to misregistration correction control in image forming apparatuses.

2. Description of the Related Art

A so-called "tandem" type image forming apparatus, in which image forming units are provided independently for each color in order to print at high speeds, is known as a type of electrophotographic image forming apparatus. Such tandem-type image forming apparatuses are configured so that images are sequentially transferred from each color image forming unit onto an intermediate transfer belt and the images are then transferred from the intermediate transfer belt onto a recording medium at one time. In such an image forming apparatus, color misregistration (misregistration) can arise when superimposing the images due to mechanical factors in each color image forming unit. The image forming apparatus therefore carries out misregistration correction in order to form high-quality images.

Misregistration occurs when the positions, shapes, and so on of components involved in image formation change due to changes in temperature in the image forming apparatus resulting from continuous printing. It is thus necessary to execute misregistration correction periodically, even when continuous printing is underway. However, a user cannot print while the misregistration correction is underway, resulting in downtime for the user. Accordingly, there is demand for an image forming apparatus that improves the usability by reducing such downtime.

Japanese Patent Laid-Open No. 2012-032777 discloses a configuration that corrects misregistration by detecting an electrostatic latent image for correction formed on a photosensitive member in order to reduce downtime.

However, although the configuration disclosed in Japanese Patent Laid-Open No. 2012-032777 can correct misregistration originating on the photosensitive member, the configuration cannot correct misregistration originating on an intermediate transfer belt.

SUMMARY OF THE INVENTION

According to an aspect of the present invention, an image forming apparatus comprising: an image forming unit configured to form developer images of a plurality of colors on an image carrier; and a control unit configured to execute a first correction control and a second correction control that has a higher correction precision than the first correction control in order to correct misregistration between the developer images formed by the image forming unit. The control unit is further configured to execute the second correction control when a cumulative correction error, which is a cumulative value of correction error occurring when performing misregistration correction using the first correction control, exceeds a first threshold.

Further features of the present invention will become apparent from the following description of exemplary embodiments with reference to the attached drawings.

BRIEF DESCRIPTION OF THE DRAWINGS

FIGS. 8A and 8B are diagrams illustrating examples of tables used by an image forming apparatus for misregistration correction.

FIGS. 9A and 9B are diagrams illustrating examples of tables used by an image forming apparatus for misregistration correction.

DESCRIPTION OF THE EMBODIMENTS

Hereinafter, exemplary embodiments of the present invention will be described with reference to the drawings. Note that constituent elements not necessary for the descriptions of embodiments have been omitted from the drawings. Note also that the following embodiments are to be taken as examples only, and are not intended to limit the scope of the present invention.

First Embodiment

In the present embodiment, the following three types of misregistration correction control are executed selectively:

First correction control: misregistration correction through estimation.

Second correction control: misregistration correction using an electrostatic latent image.

Third correction control: misregistration correction using a developer image.

Figure 1:
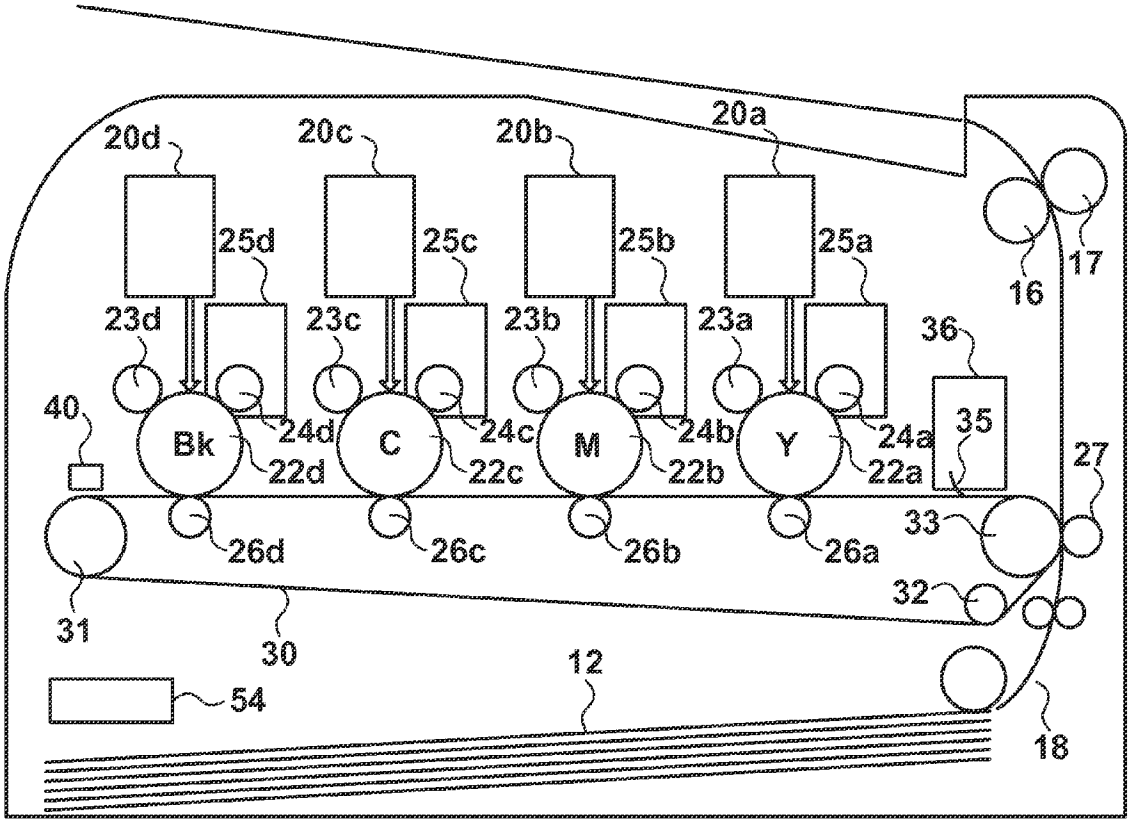
FIG. 1 is a schematic diagram illustrating an overview of an image forming apparatus according to an embodiment.

FIG. 1 is a schematic diagram illustrating an overview of an image forming apparatus according to the present embodiment. Note that the letters a, b, c, and d appended to reference numerals indicate that the color of a developer image whose formation the corresponding member is involved with is yellow (Y), magenta (M), cyan (C), or black (Bk), respectively. Note also that the appended letters a, b, c, and d will be left off the reference numerals in the following descriptions in cases where it is not necessary to distinguish between individual colors. A photosensitive member 22 is an image carrier, and is rotationally driven. A charging roller 23 charges a surface of a corresponding photosensitive member 22 to a uniform potential. For example, a charging bias output by the charging roller 23 is −1200 V, and as a result, the surface of the photosensitive member 22 is charged to a potential (a dark potential) of −700 V. A scanner unit 20 forms an electrostatic latent image on the photosensitive member 22 by scanning the surface of the photosensitive member 22 with a laser beam based on image data expressing an image to be formed. For example, the laser beam scanning results in a potential (a light potential) of −100 V in the areas where the electrostatic latent image is formed. A developing unit 25 holds developer of a corresponding color, and develops the electrostatic latent image on the photosensitive member 22 by supplying the developer to the electrostatic latent image on the photosensitive member 22 using a developing sleeve 24. For example, a developing bias output by the developing sleeve 24 is −350 V, and the developing unit 25 causes the developer to adhere to the electrostatic latent image using this potential. A primary transfer roller 26 transfers the developer image on the photosensitive member 22 onto an intermediate transfer belt 30 that is an image carrier and is cyclically driven using rollers 31, 32, and 33. For example, a transfer bias output by the primary transfer roller 26 is +1000 V, and the primary transfer roller 26 transfers the developer onto the intermediate transfer belt 30 using this potential. Note that at this time, the developer image on each photosensitive member 22 is transferred onto the intermediate transfer belt 30 so as to overlap, thus forming a color image.

A secondary transfer roller 27 transfers the developer image on the intermediate transfer belt 30 onto a recording medium 12 transported along a transport path 18. A fixing roller pair 16 and 17 thermally fixes the developer image transferred onto the recording medium 12. A cleaning blade 35 collects developer not transferred from the intermediate transfer belt 30 onto the recording medium 12 by the secondary transfer roller 27 into a receptacle 36. In addition, a detection sensor 40 is provided facing the intermediate transfer belt 30 in order to correct misregistration by forming the developer image. Note that a control unit 54 controls the image forming apparatus as a whole.

Note that the scanner unit 20 can also scan the photosensitive member 22 using an LED array or the like rather than a laser. Furthermore, rather than employing the intermediate transfer belt 30, the image forming apparatus may be a direct-transfer type that directly transfers the developer image from each photosensitive member 22 onto the recording medium 12.

Figure 2A:
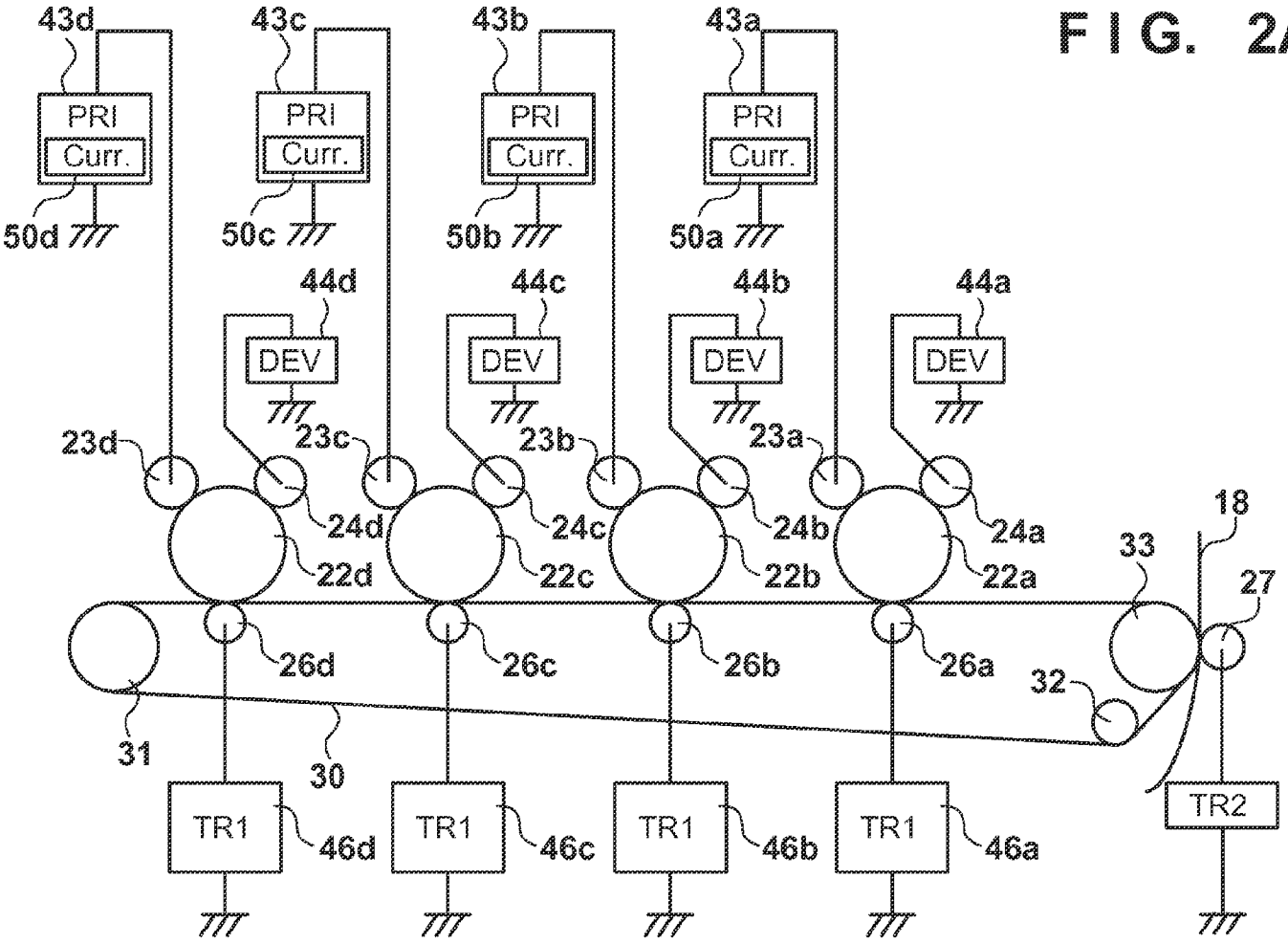
FIGS. 2A and 2B are diagrams illustrating a system for supplying a voltage to an image forming apparatus according to an embodiment.

FIG. 2A illustrates a configuration for supplying power to the image forming apparatus. A charging power source circuit 43 supplies, to the charging roller 23, the charging bias through which the corresponding charging roller 23 charges the surface of the photosensitive member 22. Likewise, a developing power source circuit 44 supplies the developing bias to the corresponding developing sleeve 24, and a primary transfer power source circuit 46 supplies a primary transfer bias to the corresponding primary transfer roller 26. Note that in the present embodiment, the charging power source circuit 43 includes a current detection circuit 50.

Figure 2B:
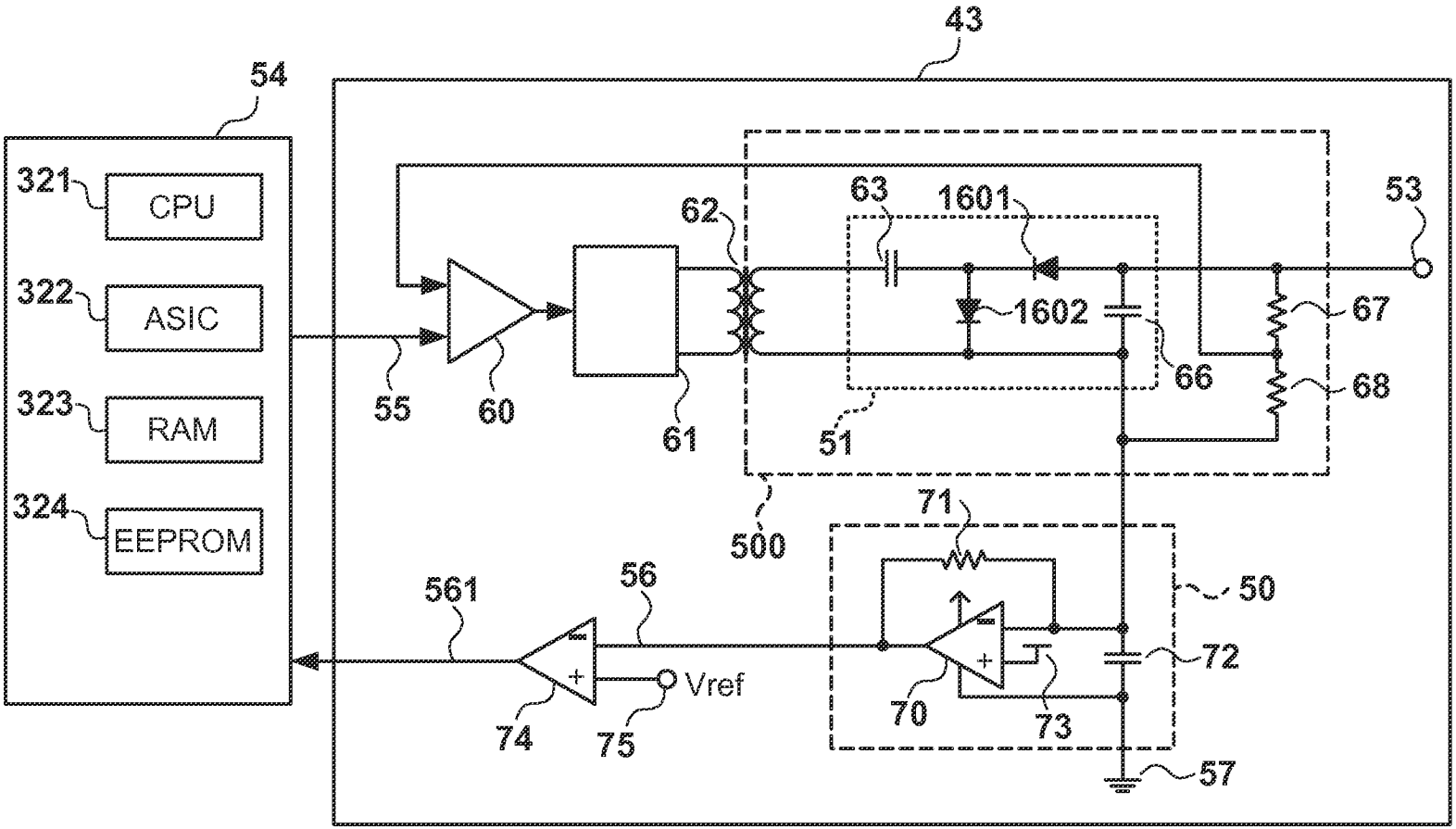

FIG. 2B illustrates a circuit configuration of the charging power source circuit 43 shown in FIG. 2A. A transformer 62 boosts the voltage of an AC signal generated by a driving circuit 61 to an amplitude several tens of times thereof. A rectifier circuit 51 including diodes 1601 and 1602 and capacitors 63 and 66 rectifies and smoothes the boosted AC voltage. The rectified and smoothed voltage is then output from an output terminal 53 as a negative DC voltage. A comparator 60 controls the output voltage of the driving circuit 61 so that the voltage of the output terminal 53 divided by detection resistances 67 and 68 equals a voltage setting value 55 set by the control unit 54. Note that a current flows through the photosensitive member 22, the charging roller 23, and to a ground in accordance with the voltage at the output terminal 53. This current is referred to as a "charging current" hereinafter.

The current detection circuit 50 is inserted between a secondary side circuit 500 of the transformer 62 and a ground 57. An input terminal of an operational amplifier 70 has a high impedance and almost no current flows therein, and thus almost all of the charging current flows to a resistance 71. Meanwhile, the potential at an inverted input terminal of the operational amplifier 70 is approximately equal to a reference voltage 73 connected to a non-inverted input terminal. Accordingly, a detection voltage 56 corresponding to the charging current appears at an output terminal of the op operational amplifier 70. Specifically, the detection voltage 56 decreases as the charging current rises and the detection voltage 56 increases as the charging current drops. Note that a capacitor 72 is provided to stabilize the inverted input terminal of the operational amplifier 70.

The detection voltage 56 corresponding to the charging current is input to a negative terminal of a comparator 74. A reference voltage (Vref) 75 serving as a threshold is input to a positive terminal of the comparator 74, and a binary voltage 561 based on a magnitude relationship between the detection voltage 56 and the reference voltage 75 serving as the threshold is input to the control unit 54. Specifically, the comparator 74 outputs a high-level signal when the detection voltage 56 is lower than the reference voltage 75, and outputs a low-level signal when such is not the case.

As described above, in the present embodiment, an electrostatic latent image for correction (hereinafter referred to as a "latent image mark") is used in the second correction control. Also as described above, the potential (light potential) of the surface of the photosensitive member 22 corresponding to the latent image mark is −100 V, for example, whereas the potential (dark potential) of the other parts of the surface of the photosensitive member 22 is −700 V, for example. Furthermore, as described above, the potential of the charging roller 23 is −1200 V, for example. Because the value of the charging current is determined by a potential difference between the surface of the photosensitive member 22 and the charging roller 23, the charging current is greater while the latent image mark is passing a position that faces the charging roller 23 than when passing other positions. Accordingly, the detection voltage 56 is lower while the latent image mark is passing the position that faces the charging roller 23 than when passing other positions. The reference voltage 75 is set to a value that is between a minimum value of the detection voltage 56 during the stated passage and a value of the detection voltage 56 prior to the stated passage so that the latent image mark passing the position opposite to the charging roller 23 can be detected. Accordingly, when a single latent image mark passes the position opposite to the charging roller 23, the comparator 74 outputs the binary voltage 561 having a single rise and a single fall. The control unit 54 employs, for example, a midpoint between the rise and fall of the binary voltage 561 as a detection position of the latent image mark. Note, however, that one of the rise and fall of the binary voltage 561 can also be employed as the detection position of the latent image mark.

The control unit 54 shown in FIG. 2B carries out overall control of the operations of the image forming apparatus illustrated in FIG. 1. Specifically, a CPU 321 of the control unit 54 uses a RAM 323 as a main memory and a work area, and controls the operations of the image forming apparatus described above in accordance with various types of control programs stored in an EEPROM 324. Meanwhile, an ASIC 322 controls various motors, controls a high-voltage power source for the developing bias, and so on during various types of printing sequences, based on instructions from the CPU 321. Note that some or all of the functions of the CPU 321 may be realized by the ASIC 322, and conversely, some or all of the functions of the ASIC 322 may be realized instead by the CPU 321. Furthermore, some of the functions of the control unit 54 may be offloaded onto hardware corresponding to another control unit 54.

Figure 3:
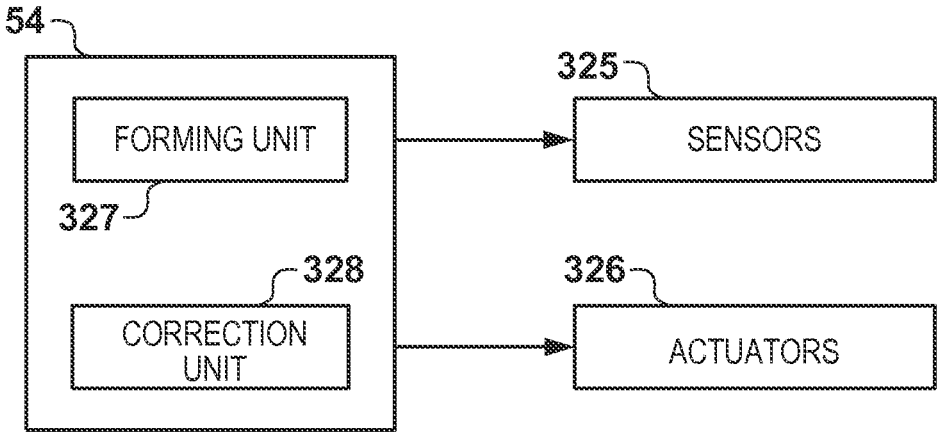
FIG. 3 is a diagram illustrating a control configuration in an image forming apparatus according to an embodiment.

FIG. 3 is a functional block diagram illustrating a control configuration of the control unit 54. "Sensors 325" is a general term indicating types of sensors such as the current detection circuit 50, the detection sensor 40, and so on. "Actuators 326" is a general term indicating types of actuators such as a driving motor for the photosensitive member 22, separating motors that cause the developing unit 25 and the photosensitive member 22 to come into contact with/separate from each other, and so on. The control unit 54 performs various types of processes based on information obtained from the various types of sensors 325. For example, a forming unit 327 forms the latent image mark, a developer image for misregistration correction, and so on in the second correction control, the third correction control, and so on. Meanwhile, a correction unit 328 selects and executes one of the aforementioned first correction control to third correction control.

Hereinafter, the three types of misregistration correction control according to the present embodiment will be described.

Misregistration Correction Using a Developer Image (Third Correction Control)

Figure 4:
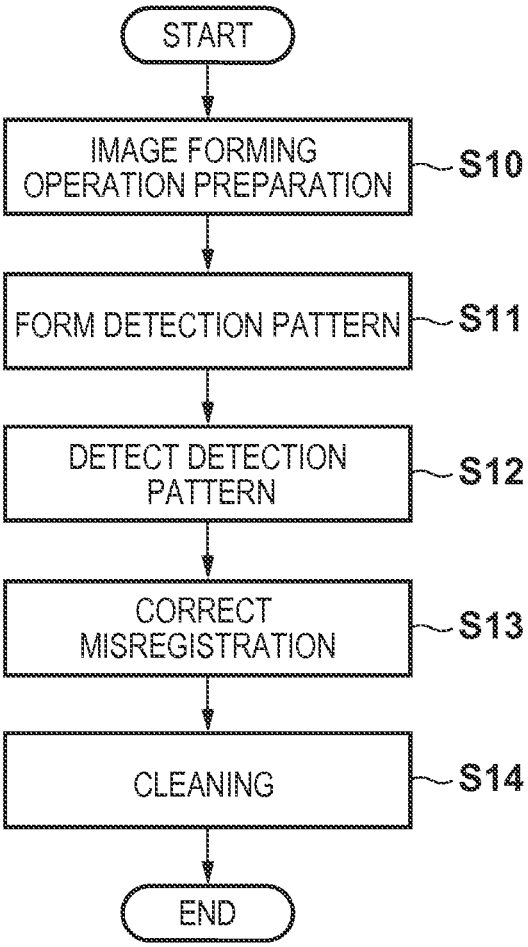
FIG. 4 is a flowchart illustrating an example of misregistration correction using an electrostatic latent image.
Figure 5A:
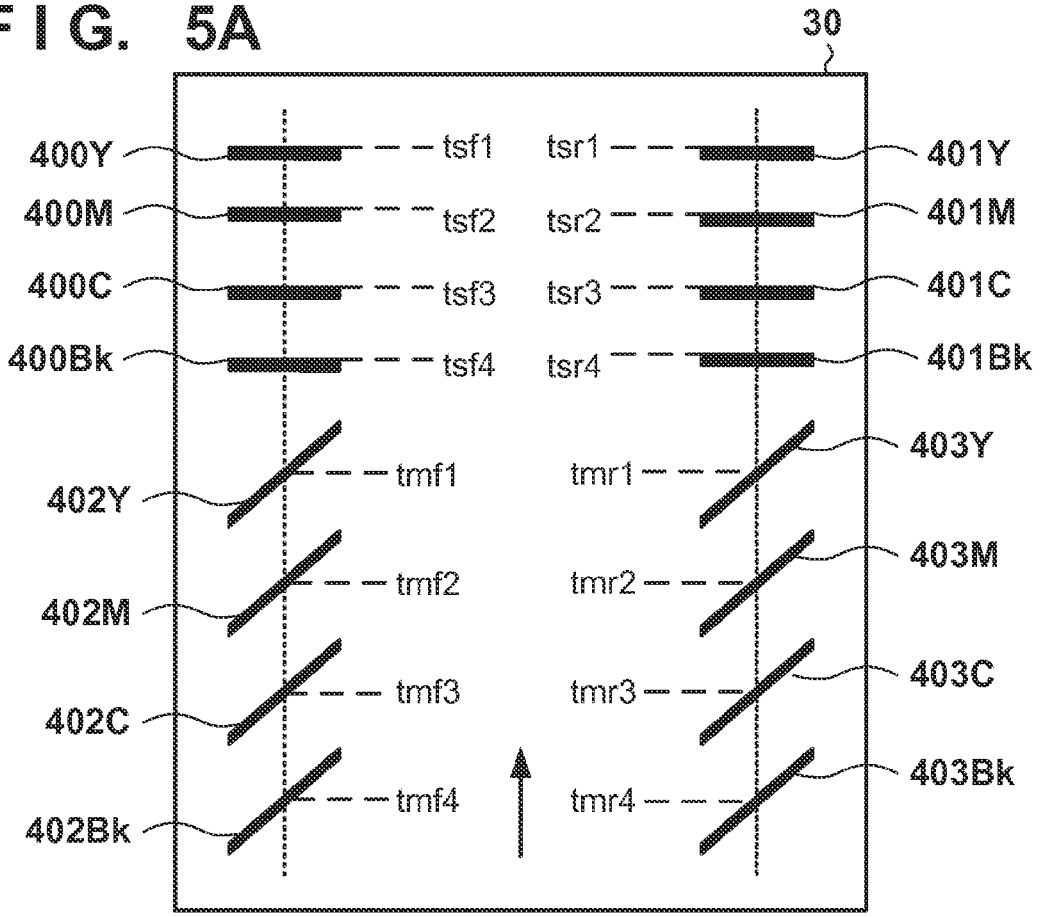
FIG. 5A is a diagram illustrating a detection pattern according to an embodiment.

FIG. 4 is a flowchart illustrating misregistration correction using a developer image. In S10, the control unit 54 performs preparatory operations for image formation, and in S11, the control unit 54 forms, on the intermediate transfer belt 30, a detection pattern including marks 400, 401, 402, and 403 using developer, as shown in FIG. 5A. In FIG. 5A, the marks 400 and 401 form a pattern for detecting a misregistration amount in a moving direction of the intermediate transfer belt 30 (a sub scanning direction). Meanwhile, the marks 402 and 403 form a pattern for detecting a misregistration amount in a main scanning direction, which is orthogonal to the moving direction of the intermediate transfer belt 30. Note that an arrow in FIG. 5A corresponds to the moving direction of the intermediate transfer belt 30, that is, the sub scanning direction. In the example shown in FIG. 5A, the marks 402 and 403 are slanted 45 degrees relative to the main scanning direction. Note that the letters Y, M, C, and Bk appended to the reference numerals of the marks 400 to 403 indicate that the corresponding mark is formed from yellow, magenta, cyan, or black developer. Furthermore, each dotted line that passes through the marks in FIG. 5A indicates the detection position of the detection sensor 40.

In S12, the control unit 54 detects the marks in the detection pattern using the detection sensor 40. tsfl-4, tmfl-4, tsrl-4, and tmrl-4 for the respective marks in FIG. 5A indicate detection times at which the detection sensor 40 has detected the corresponding mark. Note that a known technique can be employed to detect the marks using the detection sensor 40, such as using reflected light produced by irradiating the detection pattern with light. In S13, the control unit 54 obtains misregistration amounts in the sub scanning direction and the main scanning direction based on the detection time of each mark in FIG. 5A, and corrects misregistration. Note that the method for calculating the misregistration amount is a known technique and thus detailed descriptions thereof will be omitted. To describe briefly, the control unit 54 determines a distance between marks based on a moving velocity of the intermediate transfer belt 30 and a time difference between the detection times of the marks, and then calculates the misregistration amount based on the theoretical distance between the marks. Note also that the misregistration amount in the main scanning direction can be obtained from the marks 402 and 403 because when the marks 402 and 403 shift in the main scanning direction, the distance from the marks 400 and 401 at the detection position of the detection sensor 40 changes. In S14, the control unit 54 removes the detection pattern and cleans the intermediate transfer belt 30.

In the misregistration correction control that uses the developer image, the detection pattern is formed on the intermediate transfer belt 30, and the misregistration amount calculation is first carried out when the detection pattern reaches the detection region of the detection sensor 40. Accordingly, this misregistration correction requires the greatest amount of time of the three types of misregistration correction control used in the present embodiment. However, this misregistration correction control can calculate the misregistration amount having taken into account all of the factors that cause misregistration, including variations in the illumination position of the scanner unit 20, variations in the rotational velocity of the photosensitive member 22, and variations in the movement velocity of the surface of the intermediate transfer belt 30, and therefore offers the best misregistration correction. Furthermore, in the misregistration correction control that uses a developer image, the misregistration amount in the main scanning direction can be detected as well as the misregistration amount in the sub scanning direction.

Misregistration Correction Using a Latent Image Mark (Second Correction Control)

Figure 6A:
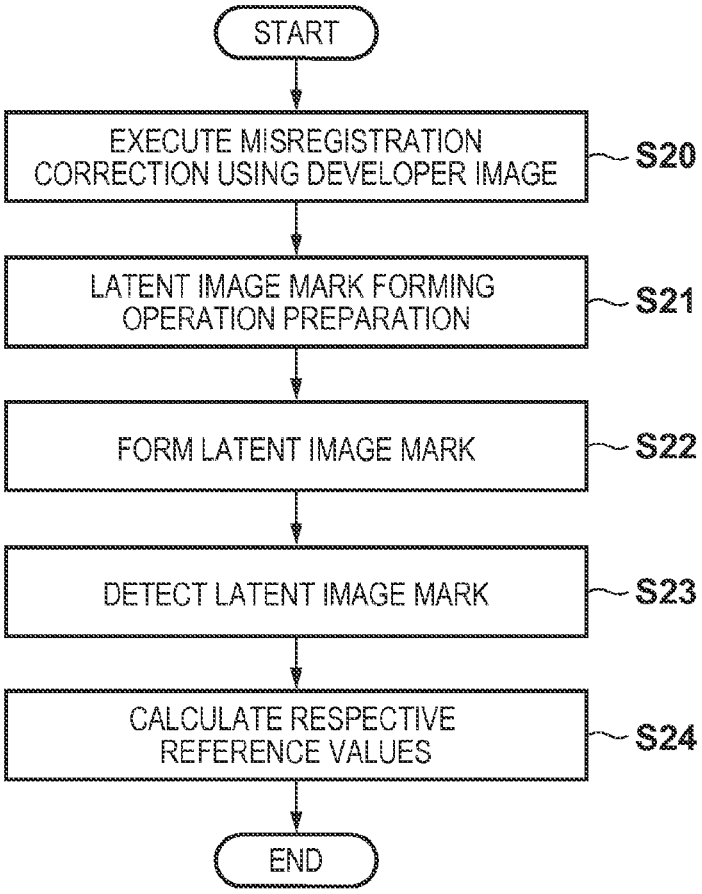
FIGS. 6A and 6B are flowcharts illustrating an example of misregistration correction using a latent image mark.
Figure 6B:
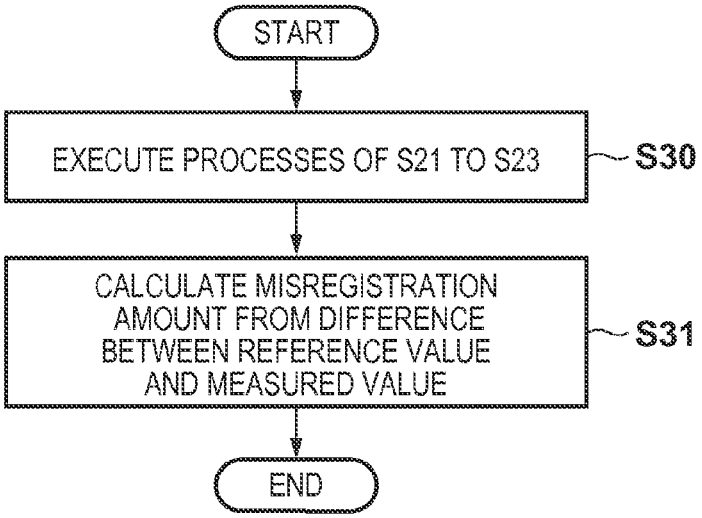

Next, the misregistration correction using a latent image mark will be described using FIGS. 6A and 6B. The misregistration correction using a latent image mark includes two processes, namely a process for obtaining a reference value and a process for correcting misregistration based on the reference value. FIG. 6A is a flowchart illustrating the process for obtaining the reference value.

Figure 5B:
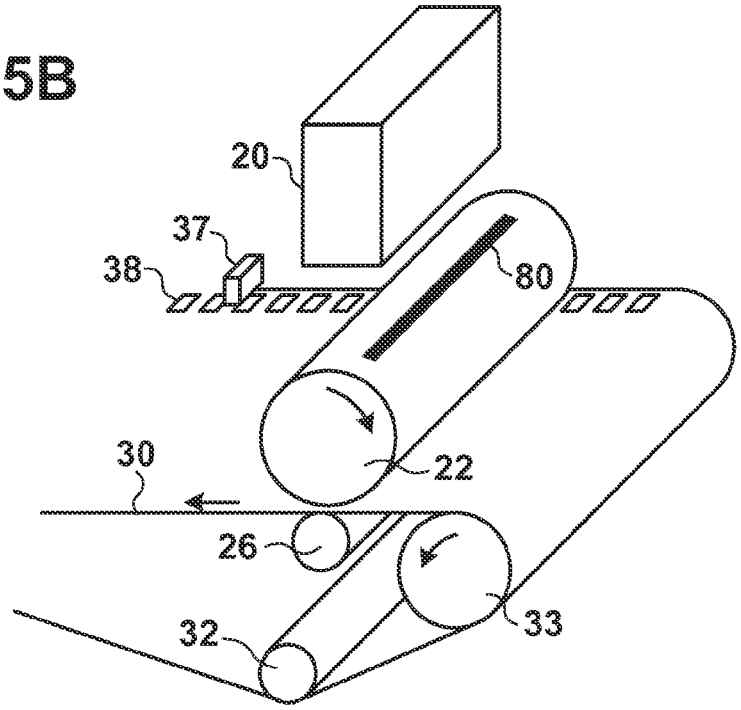
FIG. 5B is a diagram illustrating a latent image mark according to an embodiment.

In S20, the control unit 54 executes the process illustrated in FIG. 4. Doing so results in a minimum amount of misregistration. Then, in S21, the control unit 54 performs preparatory operations for forming the latent image mark, and in S22, forms one or more latent image marks on the photosensitive member 22. FIG. 5B illustrates a state in which a latent image mark 80 has been formed on the photosensitive member 22. Note that a detection sensor 37 and belt velocity detection marks 38 illustrated in FIG. 5B are not used in the present embodiment. In S23, the control unit 54 detects the latent image mark based on the charging current. In S24, the control unit 54 saves the amount of time until the latent image mark 80 formed in S22 is detected in S23 as the reference value. Note that in the case where a plurality of latent image marks 80 are formed, an average value of the times until each latent image mark 80 that has been formed is detected can be used as the reference value. Note that this process is executed for each photosensitive member 22.

Next, misregistration correction using the reference value obtained through the process illustrated in FIG. 6A will be described using FIG. 6B. In S30, the control unit 54 executes the processes of S21 to S23 of FIG. 6A, and measures the amount of time from the formation to detection of the latent image mark 80, for each photosensitive member 22. Then, in S31, the control unit 54 carries out correction using a difference between the measured time and the reference value as the misregistration amount. In other words, the control unit 54 carries out the correction so that the time from the formation to detection of the latent image mark 80 matches the reference value.

In the misregistration correction using the latent image mark 80, the misregistration amount detection can be started by the latent image mark 80 reaching a position that faces the charging roller 23, and thus can be carried out in a shorter amount of time than the misregistration correction using a developer image. However, this correction cannot detect misregistration caused by the intermediate transfer belt 30, such as variations in the movement velocity of the surface of the intermediate transfer belt 30, and thus the misregistration amount is less precise than when using a developer image.

Misregistration Correction Through Estimation (First Correction Control)

Figure 7:
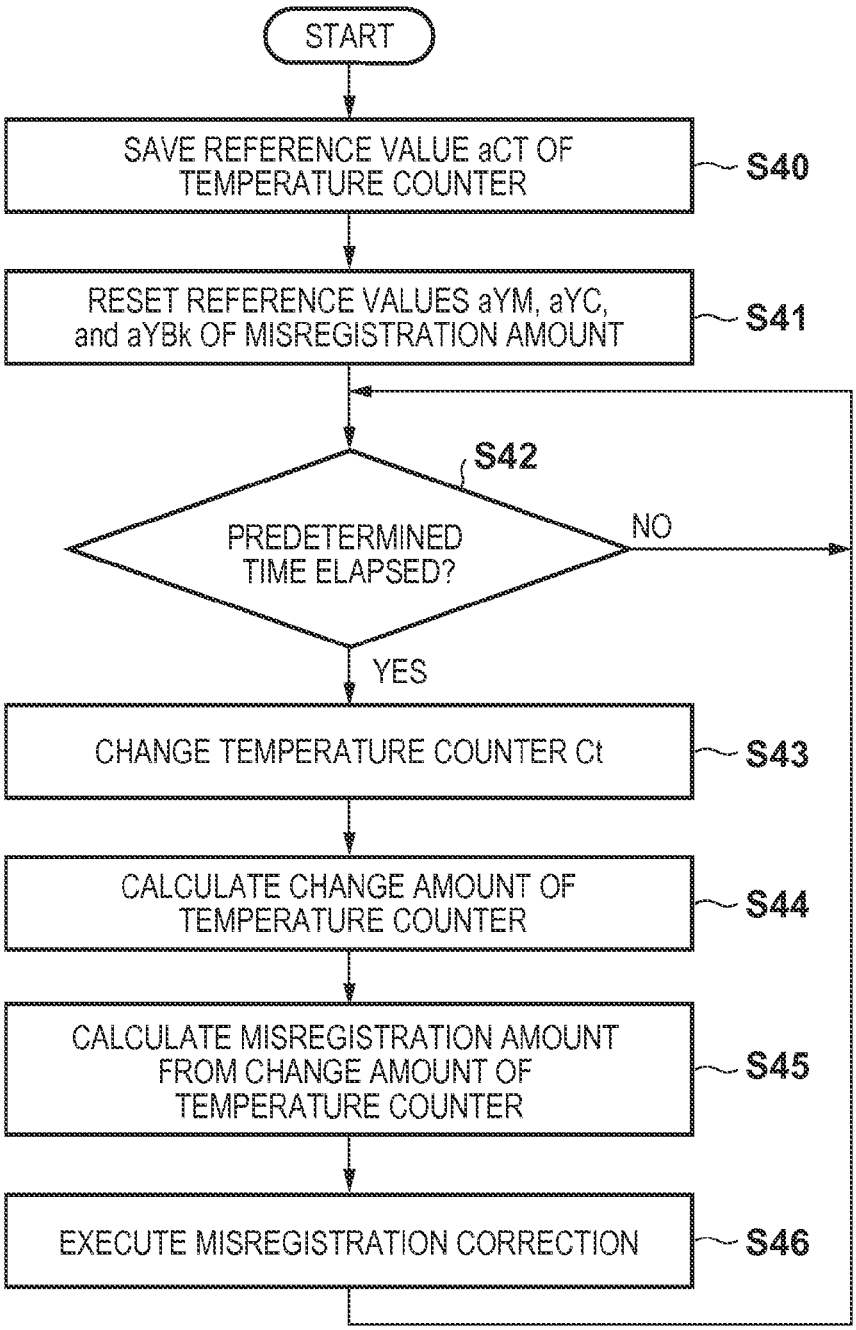
FIG. 7 is a flowchart illustrating an example of misregistration correction through estimation.

The misregistration correction through estimation will be described using the flowchart in FIG. 7. The misregistration correction through estimation employs a temperature counter Ct. The temperature counter Ct simulates a temperature within the apparatus. Note that when the image forming apparatus is turned on, the temperature counter Ct is reset to 0. When the misregistration correction through estimation starts, in S40, the control unit 54 saves the temperature counter at that point in time as a reference value aCT. In S41, the control unit 54 resets misregistration amounts aYM, aYC, and aYBk occurring at that point in time. Here, the misregistration amounts aYM, aYC, and aYBk indicate misregistration amounts of magenta, cyan, and black relative to yellow in terms of numbers of lines. For example, in the case where the control unit 54 recognizes the misregistration amount at that point in time, the misregistration amount is reset to that misregistration amount. On the other hand, in the case where the control unit 54 does not recognize the misregistration amount at that time, the misregistration amount is reset to a predetermined value, such as 0. In S42, the control unit 54 waits until a predetermined amount of time has passed, and in S43, changes the temperature counter Ct. Note that the value to which the temperature counter Ct is changed follows the table shown in FIG. 8A, which is saved in the image forming apparatus in advance. Note also that FIG. 8A is merely an example. In S44, the control unit 54 calculates a change amount ΔCt of the current temperature counter Ct from the reference value aCT, through the formula Ct-aCT. In S45, the control unit 54 determines respective misregistration amounts ΔYM, ΔYC, and ΔYBk based on the change amount ΔCt in the temperature counter and a table shown in FIG. 8B that is saved in the image forming apparatus in advance. Note that the table shown in FIG. 8B is merely an example, and indicates misregistration amounts in terms of numbers of lines. In S46, the control unit 54 corrects the misregistration amount found in S45, and repeats the process from S42.

In the present embodiment, values obtained by averaging the variation properties of misregistration amounts measured for a plurality of individual image forming apparatuses of the same model are used as the values in the table shown in FIG. 8B. Unlike the other two types of misregistration correction, the misregistration correction through estimation produces no downtime. However, because the correction uses estimated values based on average properties of the image forming apparatus rather than actually-measured values, the precision of the misregistration correction is the lowest of the three types.

Note that the misregistration correction can employ any desired method, such as adjusting the illumination timing of the scanner unit 20, correcting the rotational velocity of the photosensitive member 22, mechanically adjusting the position of a reflecting mirror provided in the scanner unit 20, and so on.

Next, detection error in each type of misregistration correction will be described. Because detection error results in misregistration correction error, detection error will be called "correction error" hereinafter.

Correction Error in Misregistration Correction Through Estimation

In the misregistration correction through estimation, a difference between the misregistration amount in the image forming apparatus in question and an average value of misregistration amounts in a plurality of image forming apparatuses used to create the tables in FIGS. 8A and 8B corresponds to the correction error. Accordingly, the value of a difference between a maximum value of variation between the misregistration amounts in the plurality of image forming apparatuses and the average misregistration amount is used as the correction error. FIG. 9A illustrates correction error when the misregistration correction through estimation has been executed once. Each time the misregistration correction through estimation is executed, the control unit 54 integrates the values in FIG. 9A and saves the result as a cumulative correction error (first cumulative correction error) for the misregistration correction through estimation. Note that the table in FIG. 9A indicates the misregistration amounts in terms of a number of lines.

Correction Error in Misregistration Correction Using a Latent Image Mark

Because the misregistration correction using a latent image mark detects the misregistration amount resulting from a several factors out of a plurality of factors that cause misregistration, misregistration amounts resulting from other factors corresponds to the correction error. In the present embodiment, the value of a difference between the misregistration amount in the misregistration correction using a latent image mark and the misregistration amount in the case where the misregistration correction through estimation has been executed is employed as the correction error for the misregistration correction using a latent image mark. Accordingly, each time the misregistration correction using a latent image mark is executed, the control unit 54 integrates the correction error and takes the result of the integration as a cumulative correction error (second cumulative correction error) for the misregistration correction using a latent image mark.

Correction Error in Misregistration Correction Using a Developer Image

In the present embodiment, the correction error for the misregistration correction using a developer image is assumed to be 0. Note that when the misregistration correction using a developer image is executed, the cumulative correction error of the misregistration correction through estimation and the misregistration correction using a latent image mark are reset to their initial values, or in other words, to 0.

Misregistration Correction According to the Present Embodiment

The overall misregistration correction according to the present embodiment will be described next. Note that when the apparatus is turned on, the process illustrated in FIG. 6A is carried out, and a reference value for misregistration correction using a latent image mark is obtained. Furthermore, the error in the misregistration correction through estimation, or in other words, the first cumulative correction error, and the error in the misregistration correction using a latent image mark, or in other words, the second cumulative correction error, are reset to their initial values of 0.

Figure 10:
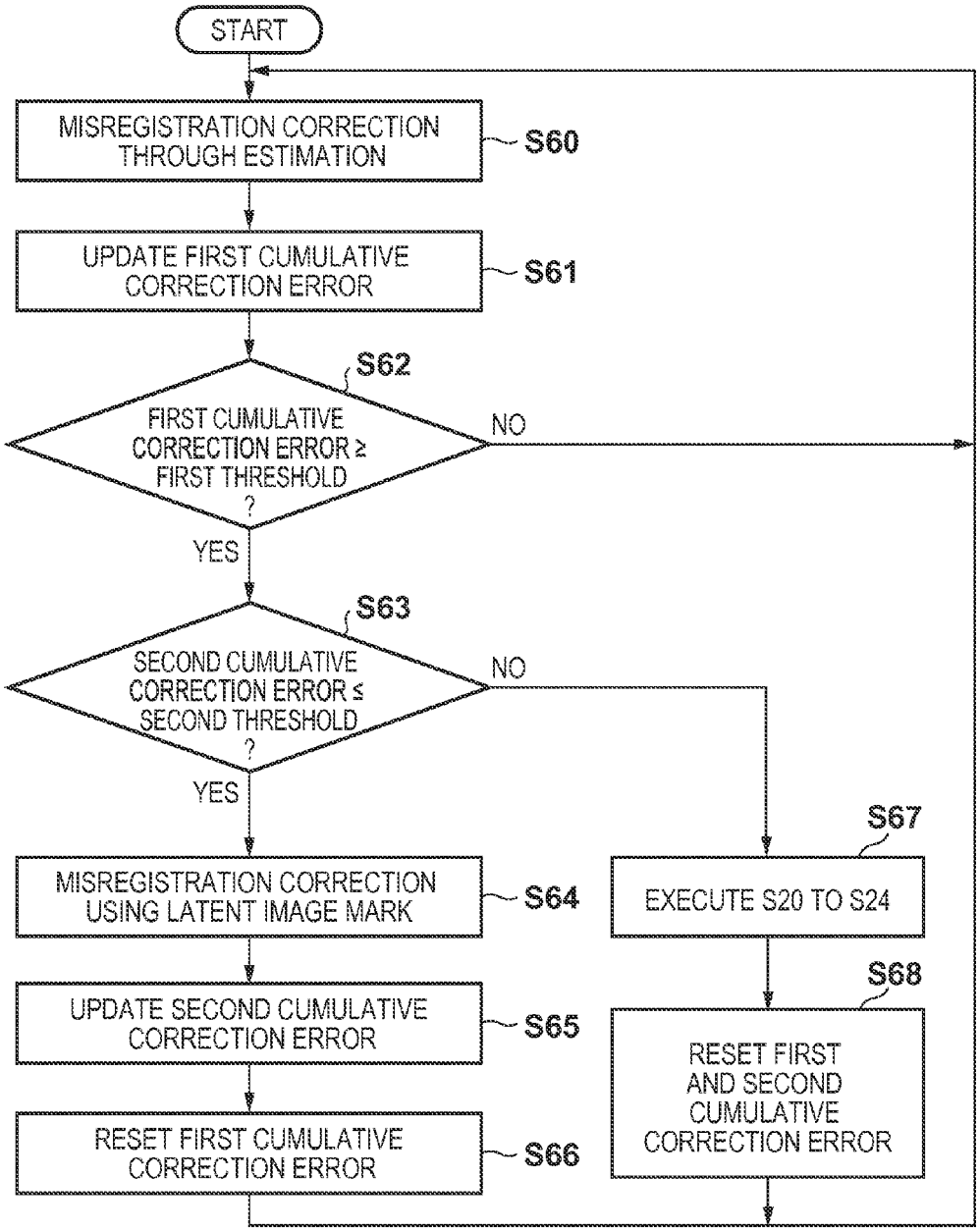
FIG. 10 is a flowchart illustrating an overall misregistration correction process according to an embodiment.

FIG. 10 is a flowchart illustrating a process executed by the control unit 54 after the process performed when the power is turned on has been executed. In S60, the control unit 54 executes the misregistration correction through estimation illustrated in FIG. 7, and in S61, updates the first cumulative correction error. Then, in S62, the control unit 54 determines whether the first cumulative correction error has become greater than or equal to a predetermined first threshold. If the first cumulative correction error is less than the first threshold, the process of S60 is repeated at the timing of the next misregistration correction.

On the other hand, when the first cumulative correction error becomes greater than or equal to the first threshold, in S63, the control unit 54 determines whether the second cumulative correction error is less than or equal to a second threshold. If the second cumulative correction error is less than or equal to the second threshold, the control unit 54 executes the misregistration correction using a latent image mark described with reference to FIG. 6B at the timing of the next misregistration correction indicated in S64, and updates the second cumulative correction error in S65. Thereafter, in S66, the control unit 54 sets the first cumulative correction error to an initial value of 0 and returns to S60. Note that it is not absolutely necessary to set the first cumulative correction error to the initial value of 0, and for example, the first cumulative correction error may be set to the initial value of 0 along with the second cumulative correction error in S68, which will be mentioned later.

On the other hand, in S63, when the second cumulative correction error is greater than the second threshold, the control unit 54 carries out the misregistration correction using a developer image and the process for obtaining the reference value for the misregistration correction using a latent image mark at the timing of the next misregistration correction, as indicated in S67. In other words, the processes of S20 to S24 shown in FIG. 6A are executed. Thereafter, in S68, the control unit 54 sets the first cumulative correction error and the second cumulative correction error to an initial value of 0 and returns to S60. Note that the misregistration correction using a latent image mark performed thereafter uses the newest reference value obtained in S67. The control unit 54 executes the misregistration correction by repeating the process illustrated in FIG. 10 until the power is turned off.

According to the present embodiment, the misregistration correction through estimation, which has a low correction precision but does not produce downtime, is executed, and the first cumulative correction error occurring during the misregistration correction through estimation is monitored. When the first cumulative correction error exceeds a permissible range, the misregistration correction using a latent image mark, which produces downtime but has a higher correction precision, is executed; the second cumulative correction error is updated, and the first cumulative correction error is set to 0. Thereafter, when the first cumulative correction error and the second cumulative correction error both exceed their respective permissible ranges, the misregistration correction using a developer image, which produces a long downtime but offers the highest correction precision, is executed. In other words, the control unit 54 increases the frequency of execution of types of misregistration correction control that have lower correction precisions but produce less downtime. This configuration makes it possible to reduce downtime while maintaining a high level of precision in the misregistration correction.

In the present embodiment, three types of misregistration correction control offering different levels of correction precision are executed selectively. However, two types of misregistration correction control offering different levels of correction precision, such as misregistration correction through estimation and misregistration correction using a developer image, misregistration correction using a latent image mark and misregistration correction using a developer image, and so on, may be executed selectively. In this case, the control unit 54 carries out control so that the correction offering a lower level of precision is executed more frequently than the correction offering a high level of precision. In other words, the control unit 54 executes the misregistration correction offering a lower level of precision and monitors the cumulative correction error thereof; when the cumulative correction error exceeds a permissible range, the control unit 54 executes the misregistration correction offering a higher level of precision, and sets the cumulative correction error of the misregistration correction offering a lower level of precision to 0.

In addition, in the present embodiment, the latent image mark is detected based on the charging current flowing between the photosensitive member 22 and the charging roller 23. However, the latent image mark can be detected based on a developing current or a transfer current flowing between the developing sleeve 24 or the primary transfer roller 26 that applies a voltage to the photosensitive member 22 and the photosensitive member 22, and the like. Accordingly, the current detection circuit 50 may be provided in the developing power source circuit 44, the primary transfer power source circuit 46, or the like instead of in the charging power source circuit 43, and may detect the latent image mark based on the developing current, the transfer current, or the like. Furthermore, in the case where, for example, constant current control that controls the transfer current to a constant value is employed, changes in the surface potential of the photosensitive member 22 are detected as changes in the voltage output by the primary transfer power source circuit 46. In other words, a configuration in which the latent image mark 80 is detected based on an output voltage in addition to the currents output to the charging roller 23, the developing sleeve 24, and the primary transfer roller 26 from the power source circuit can be employed as well.

Furthermore, in the present embodiment, the cumulative correction error is obtained using the value of the difference between the misregistration amount in the misregistration correction through estimation and the misregistration amount in the misregistration correction using a latent image mark as the correction error in the misregistration correction using a latent image mark. However, for example, a value obtained by multiplying the cumulative correction error in the misregistration correction through estimation by a predetermined correction coefficient can be taken as the correction error in the misregistration correction using a latent image mark, and the calculation of the cumulative correction error can be simplified. Furthermore, although the temperature in the image forming apparatus is estimated and the misregistration amount is estimated based on the estimated temperature in the misregistration correction through estimation, the configuration may be such that the temperature in the image forming apparatus is actually measured and the misregistration amount is estimated based on the measured temperature.

Second Embodiment

Hereinafter, a second embodiment will be described, focusing on the differences from the first embodiment. The present embodiment differs from the first embodiment in that correction that takes into consideration expansion/constriction of the intermediate transfer belt 30 is added when performing misregistration correction using a latent image mark.

In the present embodiment, to detect variations in the movement velocity of the surface of the intermediate transfer belt 30, a plurality of belt velocity detection marks 38 are provided at equal intervals at one end of the surface of the intermediate transfer belt 30, as shown in FIG. 5B, and the detection sensor 37 detects the belt velocity detection marks 38. The control unit 54 calculates the movement velocity of the surface of the intermediate transfer belt 30 (hereinafter referred to as "belt velocity") from the time interval between the belt velocity detection marks 38 detected by the detection sensor 37 while driving the intermediate transfer belt 30.

Figure 11A:
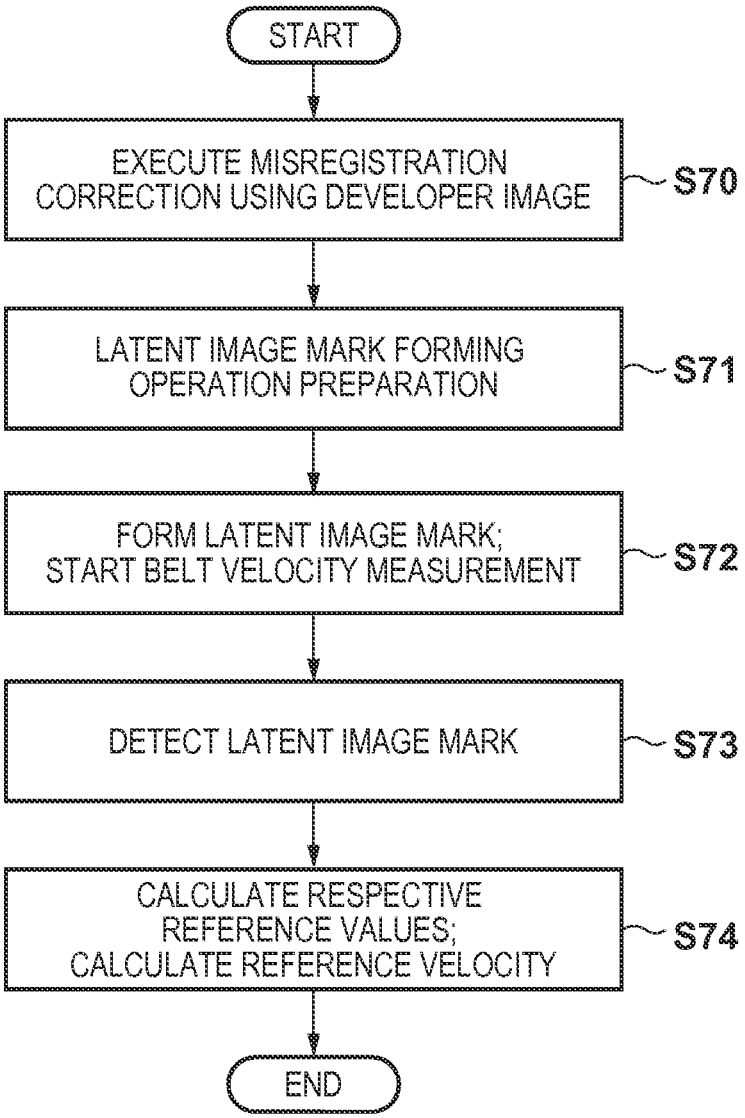
FIGS. 11A and 11B are flowcharts illustrating an example of misregistration correction using a latent image mark.

FIG. 11A is a flowchart illustrating a reference value obtainment process according to the present embodiment. In the present embodiment, a reference velocity, which is an average belt velocity value, is obtained in addition to the reference value described in the first embodiment. In S70, the control unit 54 executes the process illustrated in FIG. 4. Doing so results in a minimum amount of misregistration. Then, in S71, the control unit 54 performs preparatory operations for forming the latent image mark, and in S72, forms one or more latent image marks on the photosensitive member 22 and starts detecting the belt velocity. In S73, the control unit 54 detects the latent image mark based on the charging current. In S74, the control unit 54 saves the amount of time until the latent image mark 80 formed in S72 is detected in S73 as the reference value. Note that in the case where a plurality of latent image marks 80 are formed, an average value of the times until each latent image mark 80 that has been formed is detected is saved as the reference value. Furthermore, in S74, the control unit 54 saves the average belt velocity value whose measurement was started in S72 as a reference velocity.

Next, misregistration correction using the reference value and the reference velocity obtained through the process illustrated in FIG. 11A will be described using FIG. 11B. In S80, the control unit 54 executes the processes of S71 to S73 of FIG. 11A, and measures the amount of time from the formation to detection of the latent image mark 80, for each photosensitive member 22. The belt velocity is also detected. In S81, the control unit 54 calculates a misregistration amount I, which is a difference between the measured time and the reference value. Next, in S82, the control unit 54 calculates a percentage N (%) of the average belt velocity value measured in S80 relative to the reference velocity through the following formula.

$$N=(Sp/\mathrm{RefS})\times 100$$

Note that Sp represents the average belt velocity value measured in S80, and RefS represents the reference velocity. In S83, the control unit 54 determines a misregistration amount L based on the percentage N. Note that the determination of the misregistration amount L uses, for example, a table indicating relationships between percentages N and misregistration amounts for each color set in advance for the image forming apparatus, as shown in FIG. 9B. Note that the table shown in FIG. 9B indicates misregistration amounts in terms of numbers of lines.

In S84, the control unit 54 takes the total of the misregistration amount I obtained in S81 and the misregistration amount L obtained in S83 as a total misregistration amount K to be corrected, and carries out a correction process. In the present embodiment, variations in the belt velocity caused by the expansion/constriction of the intermediate transfer belt 30 is taken into consideration, and thus error in the misregistration correction using a latent image mark can be suppressed.

Figure 11B:
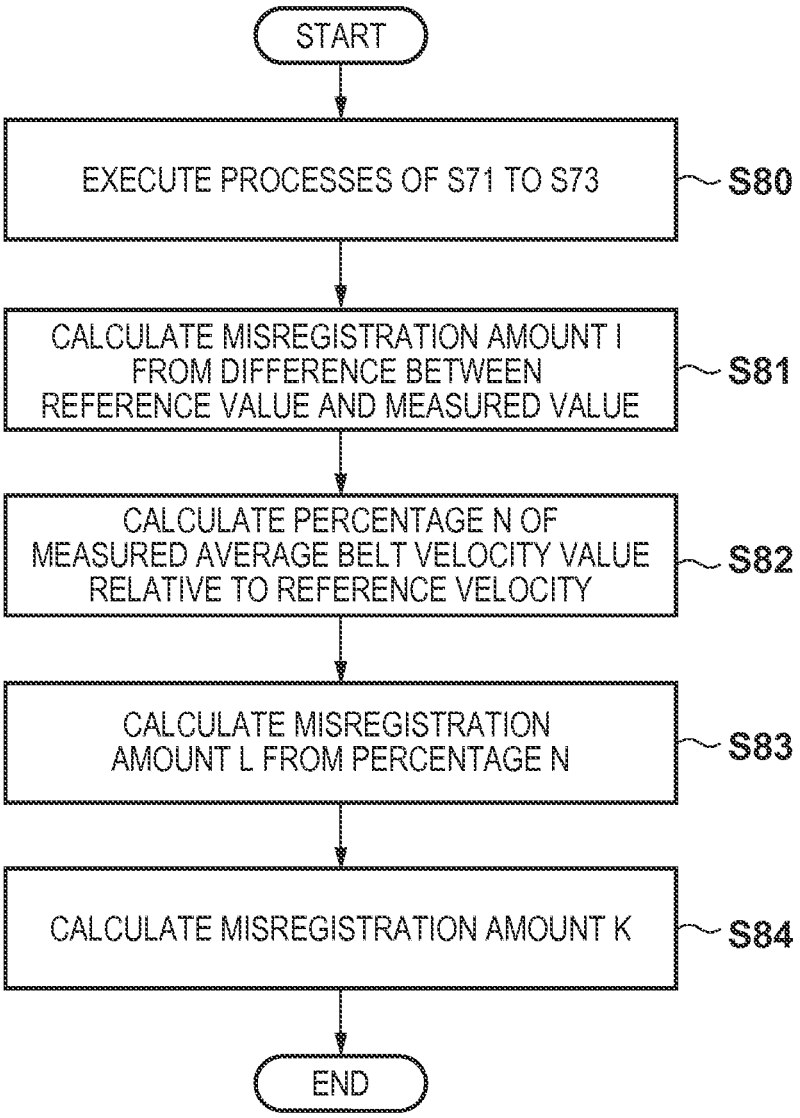

Note that in the present embodiment, the second cumulative correction error is calculated by integrating a value multiplied by a correction coefficient M with a difference between a correction amount H in the misregistration correction through estimation and the correction amount K in the misregistration correction using a latent image mark (that is, the value obtained in S84 of FIG. 11B). Note also that the correction coefficient M is a coefficient for reducing the cumulative correction error, and can be a coefficient less than 1. For example, taking into consideration the precision of the misregistration correction that employs the percentage N of the velocity variation, a correction coefficient M of 0.9 can be used.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-120107, filed on Jun. 6, 2013, which is hereby incorporated by reference herein in its entirety.

What is claimed is:

1. An image forming apparatus comprising:

an image forming unit configured to form developer images of a plurality of colors on an image carrier; and a control unit configured to execute a first correction control and a second correction control that has a higher correction precision than the first correction control in order to correct misregistration between the developer images formed by the image forming unit, wherein the control unit is further configured to determine a correction error of the first correction control when executing the first correction control, to determine a cumulative correction error, which is a cumulative value of the correction error of the first correction control, and to execute the second correction control when the cumulative correction error of the first correction control exceeds a first threshold.

2. The image forming apparatus according to claim 1, wherein the control unit is further configured to set the cumulative correction error of the first correction control to an initial value when executing the second correction control.

3. The image forming apparatus according to claim 1, wherein the first correction control is correction control carried out based on a measurement or an estimation of a temperature in the image forming apparatus, and the second correction control is correction control carried out based on detection of an electrostatic latent image formed on a photosensitive member.

4. The image forming apparatus according to claim 1, wherein the first correction control is correction control carried out based on a measurement or an estimation of a temperature in the image forming apparatus, and the second correction control is correction control carried out based on detection of a developer image formed on the image carrier by the image forming unit.

5. The image forming apparatus according to claim 3, wherein the cumulative correction error of the first correction control is determined based on a measured temperature or an estimated temperature in the image forming apparatus.

6. The image forming apparatus according to claim 1, wherein the image forming unit includes a photosensitive member on which an electrostatic latent image is formed and is further configured to form the developer image on the image carrier by developing the electrostatic latent image formed on the photosensitive member using a developer and transferring the developer image onto the image carrier; and the first correction control is correction control carried out based on detection of the electrostatic latent image formed on the photosensitive member of the image forming unit, and the second correction control is correction control carried out based on detection of the developer image formed on the image carrier by the image forming unit.

7. The image forming apparatus according to claim 1, wherein the control unit is further configured to execute a third correction control that has a higher correction precision than the second correction control when a cumulative correction error of the second correction control, which is a cumulative value of a correction error occurring when performing misregistration correction using the second correction control, exceeds a second threshold.

8. The image forming apparatus according to claim 7, wherein the control unit is further configured to set the cumulative correction errors of the first correction control and the second correction control to respective initial values when executing the third correction control.

9. The image forming apparatus according to claim 7, wherein the image forming unit includes a photosensitive member on which an electrostatic latent image is formed and is further configured to form the developer image on the image carrier by developing the electrostatic latent image formed on the photosensitive member using a developer and transferring the developer image onto the image carrier; and the first correction control is correction control carried out based on a measurement or an estimation of a temperature in the image forming apparatus, the second correction control is correction control carried out based on detection of an electrostatic latent image formed on the photosensitive member of the image forming unit, and the third correction control is correction control carried out based on detection of the developer image formed on the image carrier by the image forming unit.

10. The image forming apparatus according to claim 9, wherein the control unit is further configured to detect a movement velocity of a surface of the image carrier, and in the second correction control, a misregistration amount to be corrected is determined based on a misregistration amount obtained by detecting the electrostatic latent image and a misregistration amount caused by variations in the movement velocity of the surface of the image carrier.

11. The image forming apparatus according to claim 9, wherein the cumulative correction error of the first correction control is determined based on the measured temperature or the estimated temperature in the image forming apparatus.

12. The image forming apparatus according to claim 9, wherein the cumulative correction error of the second correction control is determined from a value based on a difference between the misregistration amount in the second correction control and a misregistration amount in the case where the first correction control is executed.

13. The image forming apparatus according to claim 9, wherein the cumulative correction error of the second correction control is determined by multiplying the cumulative correction error of the first correction control by a predetermined coefficient.

14. An image forming apparatus comprising:

an image forming unit configured to form developer images of a plurality of colors on an image carrier; and a control unit configured to execute a first correction control and a second correction control that has a higher correction precision than the first correction control in order to correct misregistration between the developer images formed by the image forming unit, wherein the control unit is further configured to execute the first correction control more frequently than the second correction control regardless of a number of execution times of the second correction control.

15. The image forming apparatus according to claim 14, wherein the control unit is further configured to execute the first correction control more frequently than the second correction control by executing the second correction control and setting a cumulative correction error of the first correction control, which is a cumulative value of correction error occurring when performing misregistration correction using the first correction control, to an initial value when the cumulative correction error of the first correction control exceeds a first threshold.

16. An image forming apparatus comprising:

an image forming unit configured to form developer images of a plurality of colors on an image carrier; and a control unit configured to execute a first correction control, a second correction control that has a higher correction precision than the first correction control, and a third correction control that has a higher correction precision than the second correction control, in order to correct misregistration between the developer images formed by the image forming unit, wherein the control unit is further configured to execute the first correction control more frequently than the second correction control and execute the second correction control more frequently than the third correction control.

17. The image forming apparatus according to claim 16, wherein the control unit is further configured to execute the first correction control more frequently than the second correction control and execute the second correction control more frequently than the third correction control by executing the second correction control and setting a cumulative correction error of the first correction control, which is a cumulative value of correction error occurring when performing misregistration correction using the first correction control, to an initial value when the cumulative correction error of the first correction control exceeds a first threshold and by executing the third correction control and setting the cumulative correction error of the first correction control and a cumulative correction error of the second correction control, which is a cumulative value of correction error occurring when performing misregistration correction using the second correction control, to respective initial values when the cumulative correction error of the second correction control exceeds a second threshold.

18. The image forming apparatus according to claim 14, wherein the first correction control is carried out based on a measurement or an estimation of a temperature in the image forming apparatus, and the second correction control is carried out based on detection of an electrostatic latent image formed on a photosensitive member.

19. The image forming apparatus according to claim 14, wherein the first correction control is carried out based on a measurement or an estimation of a temperature in the image forming apparatus, and the second correction control is carried out based on detection of a developer image formed on the image carrier by the image forming unit.

20. The image forming apparatus according to claim 14, wherein the image forming unit includes a photosensitive member on which an electrostatic latent image is formed and is further configured to form the developer image on the image carrier by developing the electrostatic latent image formed on the photosensitive member using a developer and transferring the developer image onto the image carrier; and the first correction control is carried out based on detection of the electrostatic latent image formed on the photosensitive member of the image forming unit, and the second correction control is carried out based on detection of the developer image formed on the image carrier by the image forming unit.

21. The image forming apparatus according to claim 16, wherein the image forming unit includes a photosensitive member on which an electrostatic latent image is formed and is further configured to form the developer image on the image carrier by developing the electrostatic latent image formed on the photosensitive member using a developer and transferring the developer image onto the image carrier; and the first correction control is carried out based on a measurement or an estimation of a temperature in the image forming apparatus, the second correction control is carried out based on detection of an electrostatic latent image formed on the photosensitive member of the image forming unit, and the third correction control is carried out based on detection of the developer image formed on the image carrier by the image forming unit.

22. An image forming apparatus comprising:

an image forming unit configured to form developer images of a plurality of colors on an image carrier; and a control unit configured to execute a first correction control for correcting misregistration in the developer images formed by the image forming unit, to determine a correction error of the first correction control when executing the first correction control, to determine a cumulative correction error, which is a cumulative value of the correction error of the first correction control, and to control, based on the cumulative correction error of the first correction control, a timing at which a second correction control, which is different than the first correction control and is for correcting misregistration in the developer images formed by the image forming unit, is executed.

* * * * *